US007538737B2

(12) United States Patent
Black et al.

(10) Patent No.: US 7,538,737 B2
(45) Date of Patent: May 26, 2009

(54) HIGH IMPEDANCE BICONE ANTENNA

(75) Inventors: Donald N. Black, Cumming, GA (US); John D. Voss, Cumming, GA (US); Terence D. Newbury, Hoschton, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 11/706,570

(22) Filed: Feb. 12, 2007

(65) Prior Publication Data

US 2007/0205951 A1 Sep. 6, 2007

Related U.S. Application Data

(60) Provisional application No. 60/772,233, filed on Feb. 10, 2006.

(51) Int. Cl.
*H01Q 13/00* (2006.01)

(52) U.S. Cl. ..... 343/773; 343/863

(58) Field of Classification Search ..... 343/733, 343/772, 773, 700 MS, 850, 860, 863
See application file for complete search history.

(56) References Cited

U.S. PATENT DOCUMENTS 5,134,420 A * 7/1992 Rosen et al. ..... 343/756
6,154,182 A * 11/2000 McLean ..... 343/773
7,339,529 B2 * 3/2008 Martek ..... 343/700 MS
2005/0093756 A1 * 5/2005 Martek ..... 343/773
2006/0012535 A1 1/2006 McLean

OTHER PUBLICATIONS

PCT/US07/03955, International Search Report, Oct. 19, 2007, 1 page.

* cited by examiner

*Primary Examiner*—Hoang V Nguyen
(74) *Attorney, Agent, or Firm*—King & Spalding

(57) ABSTRACT

A high impedance bicone antenna system supporting ultra wideband operation. The antenna may comprise a reduced aperture size and reduced half-angles of the conductive cones forming the antenna. Reduction in cone angles may increase the impedance of the cones. An impedance matching mechanism for interfacing to the high impedance bicone may be positioned within one of the cones by a dielectric material. The impedance matching mechanism may be a flat conductive taper functioning as an impedance matching transmission line between an external feed line and the antenna. The conductive taper may function as a center conductor of a coaxial feed mechanism where the inside of the cone around the taper serves as the outside conductor, or return, of the tapered feed. The geometry of the cones may be modified to provide one or more end segments that are substantially cylindrical.

18 Claims, 5 Drawing Sheets

HIGH IMPEDANCE BICONE ANTENNA

RELATED APPLICATION

This patent application claims priority under 35 U.S.C. §119 to U.S. Provisional Patent Application No. 60/772,233, entitled "High Impedance Bicone," filed Feb. 10, 2006. The complete disclosure of the above-identified priority application is hereby fully incorporated herein by reference.

FIELD OF THE INVENTION

The present invention relates to an omni-directional bicone antenna and more specifically to a high impedance bicone antenna with a reduced aperture size and a tapered impedance matching feed.

BACKGROUND

A bicone is generally an antenna having two conical conductors, where the conical elements share a common axis, and a common vertex. The conical conductors extend in opposite directions. That is, the two flat portions of the cones face outward from one another. The flat portion of the cone can also be thought of as the base of the cone or the opening of the cone. The flat portion, or opening, of a cone is at the opposite end of the cone from the vertex or point of the cone. Bicone antennas are also called biconical antennas. Generally, a bicone antenna is fed from the common vertex. That is, the driving signal is applied to the antenna by a feed line connected at the antenna's central vertex area.

Positioning two cones so that the points (or vertices) of the two cones meet and the openings (or bases) of the two cones extend outward (opposite one another) results in a bowtie-like appearance. As such, some bicone antennas are called bowtie antennas.

Generally, bicone antennas support a wide bandwidth, but the low end of the operating frequency range is limited by the aperture size of the antenna. The relationship between aperture size and frequency operation is generally inverse. That is, operation at a lower frequency requires a larger bicone antenna. More specifically, a traditional bicone antenna requires an aperture size of about one half of the longest operating wavelength. The longest wavelength is related to the lowest operating frequency by the wave velocity relationship, "speed of light=wavelength×frequency" where the speed of light is approximately 300,000,000 meters per second.

Lower frequency operation requires bicone antennas that can be very large. These large antennas can have high material costs, high manufacturing costs, and high handling costs. Also, the larger antenna may be difficult to handle in the field, and may be prone to damage due to the large span of the conductive elements of the antenna. Traditional bicone antenna may also require external loading and cumbersome external feed assemblies.

Accordingly, there is a need in the art for an omni-directional bicone antenna where the aperture size can be reduced while maintaining a low VSWR (voltage standing wave ratio) over a broad bandwidth. There is also a need for a bicone antenna having compact and rugged design characteristics. There is a further need in the art for a bicone antenna that requires no external loading.

SUMMARY OF THE INVENTION

The present invention comprises a broadband omni-directional bicone antenna that may have a reduced aperture size, a high input impedance at the central vertex of the cones, and an impedance matching taper to feed the cones.

The aperture size of a bicone antenna may be reduced by reducing the cone angle. Unfortunately, reducing the cone angle can also result in increasing the impedance of the antenna, thereby creating an impedance mismatch between the feed line connected to the antenna and the antenna itself. Impedance mismatches may cause reflections. In other words, energy intended for the antenna may be reflected back down the feed line to the transmitter or amplifier.

A view of the level of impedance match for a communications system may be obtained from the system's standing wave ratio (SWR). SWR is the ratio of the amplitude of a partial standing wave at an anti-node (maximum) to the amplitude at an adjacent node (minimum). SWR is usually defined as a voltage ratio called the VSWR, for voltage standing wave ratio. The voltage component of a standing wave in a uniform transmission line consists of the forward wave superimposed on the reflected wave and is therefore a metric of the reflections on the transmission line. Reflections occur as a result of discontinuities, such as an imperfection in an otherwise uniform transmission line, or when a transmission line is terminated with a load impedance other than its characteristic impedance.

An aspect of the present invention supports the design of a bicone antenna having a reduced aperture size achieved by reducing the cone angle. As discussed above, this reduction in cone angle can increase the impedance of the cones. An inventive impedance matching mechanism can be used for interfacing to the high impedance characteristic exhibited by the bicone antenna. For example, the impedance matching mechanism can be implemented by a flat conductive taper disposed within the lower cone of the bicone and functioning as an impedance matching transmission line between the external feed line to the antenna and the feed point at the vertex of the cones.

In another aspect of the present invention, a single conductive taper can be achieved by the center conductor of a coaxial feed mechanism. The inside of one of the cones, typically the "bottom" cone, can serve as the outside conductor (or shielding conductor, or return) of the tapered feed line.

In yet another aspect of the present invention, the geometry of the cones may be modified to support an end section of one or both of the cones where the end segment is substantially cylindrical. Such a geometry can support an increase in aperture length without increasing cone diameter. The increase in length can support lower frequency operation.

The discussion of high impedance bicone antennas with integrated impedance matching mechanisms presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1:
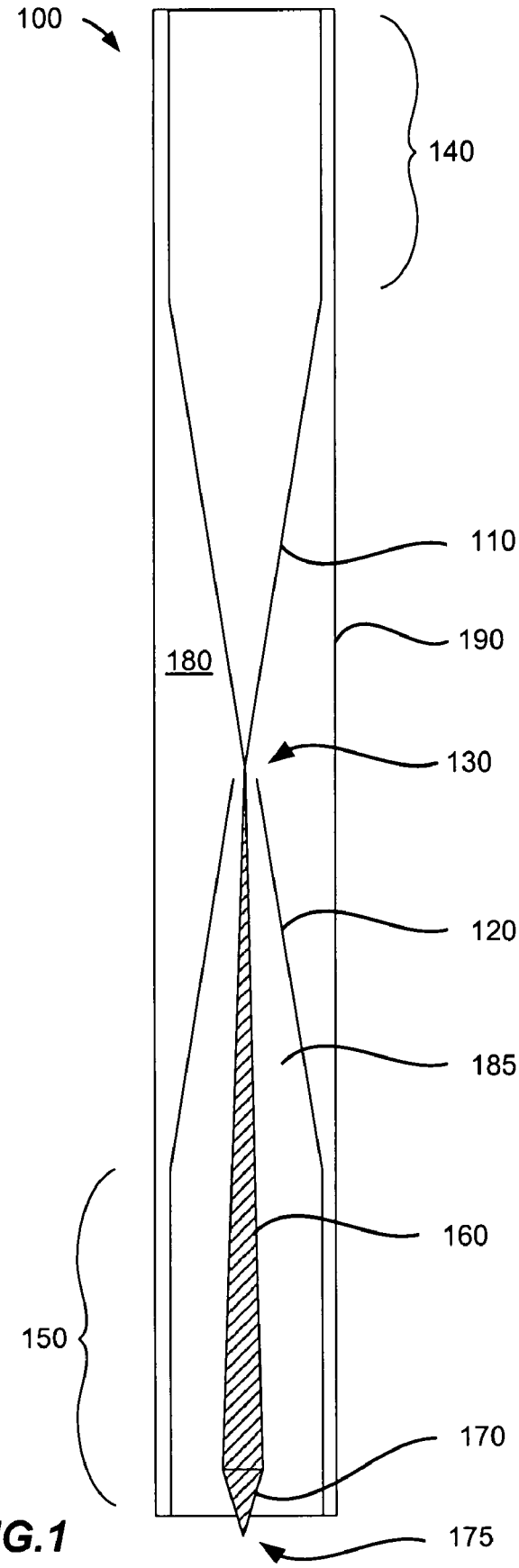
FIG. 1 illustrates a longitudinal bisection of a high impedance bicone antenna system according to one exemplary embodiment of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The present invention supports the design and operation of a bicone antenna having a reduced aperture size achieved by reducing the cone angle. This reduction in cone angle can increase the impedance of the cones thus providing a high impedance bicone antenna system. In recognition of this high impedance characteristic, an inventive impedance matching mechanism can be used to interface with the bicone antenna system. An exemplary impedance matching mechanism is implemented by a flat conductive taper disposed within a cone of the bicone antenna system. This flat conductive taper functions as an impedance matching transmission line between the external feed line to the antenna and the feed point at the vertex of the cones. The single conductive taper, useful for impedance matching, can function as the center conductor of a coaxial feed mechanism. The inside of the bottom cone can serve as the outside conductor (or shielding conductor, or return) of the tapered feed line.

The geometry of the cones may be modified to comprise an end section on one or both of the cones where the end segment is substantially cylindrical. This geometry can support an increase in aperture length without increasing the aperture diameter. The increase in length can support lower frequency operation.

While the antenna system may be referred to as specifically radiating or receiving, one of ordinary skill in the art will appreciate that the invention is widely applicable to both transmitting (exciting a medium) or receiving (be excited by a medium) without departure from the spirit or scope of the invention. Any portion of the description implying a single direction or sense of operation should be considered a non-limiting example. Such an example, that may imply a single sense or direction of operation, should be read to in fact include both directions or senses of operation in full accordance with the principle of electromagnetic reciprocity. In all cases, the antenna may both receive and transmit electromagnetic energy in support of communications applications.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Turning now to FIG. 1, the figure illustrates a longitudinal bisection of a high impedance bicone antenna system 100 according to one exemplary embodiment of the present invention. The bicone antenna system 100 comprises an upper cone 110 and a lower cone 120. The upper cone 110 and the lower cone 120 may each have reduced half-angles. For example, the half-angles of the cones may be less than thirty degrees, even as small as three degrees or smaller. The-half angle of a cone is the angle between the central axis of the cone and any side of the cone. The half-angle of the upper cone 110 may be greater than the half-angle of the lower cone 120. Such a difference may allow for the lower cone 120 to open near the central vertex 130 as illustrated. The half-angle of the upper cone 110 can also be substantially the same as or smaller than the half-angle of the lower cone 120.

This narrowing of the cones 110, 120 may reduce the aperture size of the bicone antenna 100 and also may increase the impedance of the antenna. One exemplary bicone antenna supports an operational bandwidth of 25 MHz to over 6 GHz and is characterized by a diameter of about 2 inches and an overall length of about 44 inches. This means that the height of each cone 110, 120 is about 22 inches. The VSWR over this frequency range can fall between 2:1 and 3:1. This 44 inch long bicone antenna system is considerably smaller than the traditional half wavelength design having a length of 236 inches at 25 MHz. The electrical aperture size can be reduced from the traditional half-wavelength to one-fifth-wavelength or smaller, for example, based on adoption of the disclosed inventive aspects.

To achieve this reduction in size and still maintain the desired VSWR, the bicone characteristic impedance may be increased. With the representative bicone dimensions discussed above, the impedance of the bicone antenna system can be around 306 ohms. This increased impedance characteristic of the bicone antenna system may be mismatched at the signal feed, such as a typical 50 ohm coaxial feed line. This impedance mismatch is addressed in more detail below.

An impedance mismatch between the bicone antenna elements 110, 120 and the feed line connecting to the antenna system 100 can be mitigated by an impedance matching taper 160 provided within the antenna system 100. Generally, a high impedance bicone antenna may have an impedance of about 90 ohms or higher. For example, the exemplary bicone geometry discussed above can exhibit impedances of about 306 ohms. Meanwhile, the most common form of feed line is a 50 ohm coaxial cable, commonly referred to as "coax." The impedance matching taper 160 can connect with the top cone 110 at the central vertex 130 of the antenna system. The impedance matching taper 160 may be welded, soldered, press-fit into or otherwise attached to the upper cone.

At the central vertex 130 of the antenna system 100, the impedance matching taper 160 can be very narrow and may continuously expand towards the bottom of the lower cone 120. Varying the width of the impedance matching taper 160 can control the impedance. Greater widths produce smaller impedances, and smaller widths produce larger impedances, so the width of the impedance matching taper 160 near the high impedance central vertex 130 is narrower than the width of the impedance matching taper 160 near the lower impedance feed line. Other impedance matching structures 160 may be employed. For example, the impedance matching taper 160 may be an exponential taper, a Klopfenstein taper, a continuous taper, or any other type of matching taper. Also, the impedance matching structure 160 may be coax, or other transmission line as well as conical waveguide, circular waveguide, or other waveguide. However, a single strip, continuous taper with uniform thickness may provide a low cost and low complexity solution.

At the bottom, or widest region, of the impedance matching taper 160, a reduction coupler 170 may be provided to reduce the radius of the impedance matching taper 160. The reduction coupler 170 may reduce the radius of the impedance matching taper 160 to allow the application of a connector 175 to the impedance matching taper 160. The connector 175 can provide a connection point between a feed line and the bicone antenna system 100. The connector 175 may be coaxial, N-type, F-type, BNC, waveguide flange, solder terminals, compression fitting, or any other mechanism for connecting a feed line into the antenna system 100.

The impedance matching taper 160 can generally be formed of any conductive material such as copper, aluminum, silver, bronze, brass, any other metal, metallized substrate, or any mixture and/or alloy thereof. The impedance matching taper 160 may be layered, plated, or solid. In one example, the impedance matching taper 160 can be formed from a solid metal part with a rectangular cross-section having a thickness of about 0.025 inches.

While the common 50 ohm coax has been discussed as an example, other types of feed line may be used with the antenna system 100. For example, coax, ladder line, rectangular waveguide, circular waveguide, conical waveguide, or other waveguides and/or cables may be used to feed the bicone antenna system 100. Also, the bicone may be directly feed by a high-impedance transmission line instead of using the impedance matching taper 160.

The volume within the lower cone 120 can contain a dielectric 185. The dielectric 185 can be a foam with a low dielectric constant. The foam dielectric 185 can provide mechanical support for the impedance matching taper 160. Such mechanical support may operate to position the impedance matching taper 160 in the center of the lower cone 120 in order to maintain the desired impedance. A dielectric 185 with a low dielectric constant may be useful to reduce multimode propagation along the impedance matching taper 160 within the lower cone 120. A dielectric 185 with a low dielectric constant may also be useful in supporting higher frequency performance of the antenna system 100. The dielectric 185 may be a polyethylene foam, a polystyrene foam, a foam of some other polymer or plastic, or a solid dielectric. The dielectric 185 may also be a non-continuous structure such as ribs, braces, or trussing that can be formed of plastic, polymer, fiberglass composite, glass, or some other dielectric, for example.

The cones 110, 120 of the antenna system 100 can generally be implemented by any conductive material such as copper, aluminum, silver, bronze, brass, any other metal, metallized substrate, or any mixture and/or alloy thereof. The conductive material of the cones 110/120 may be layered, plated, solid, mesh, wire array, metallized insulator, or foil, as examples.

The cones 110, 120 may be protected from the external environment by a radome 190 that covers or encloses the cones. A radome 190 is typically implemented by a structural enclosure useful for protecting an antenna from the external effects of its operating environment. For example, a radome 190 can be used to protect the surfaces of the antenna from the effects of environmental exposure such as wind, rain, sand, sunlight, and/or ice. A radome 190 may also conceal the antenna from public view. The radome 190 is typically transparent to electromagnetic radiation over the operating frequency range of the antenna. The radome 190 can be constructed using various materials such as fiberglass composite, TEFLON coated fabric, plastic, polymers, or any other material or mixture of materials that can maintain the desired level of radio transparency.

The area between the radome 190 and the cones 110, 120 can contain a dielectric 180. The dielectric 180 can be a foam with a low dielectric constant. The foam dielectric 180 can provide mechanical support for the cones 110, 120. Such mechanical support may operate to position and buffer the cones 110, 120 within the radome 190. A dielectric 180 with a low dielectric constant may be useful in maintaining the high impedance properties of the bicone antenna. The dielectric 180 may be a polyethylene foam, a polystyrene foam, a foam of some other polymer or plastic, or a solid dielectric. The dielectric 180 may also be a non-continuous structure such as ribs, braces, or trussing that can be formed of plastic, polymer, fiberglass composite, glass, or some other dielectric, for example.

While the dielectric 180 and the dielectric 185 may general be the same material, they need not be identical in a specific application. For both dielectric 180 and dielectric 185, a low dielectric constant is desired. For example, a dielectric constant of less than about two may be used for either dielectric 180 or dielectric 185. One or both of dielectric 180 and dielectric 185 may also be air.

When the central vertex 130 of the antenna system 100 is fed by a single conductor, such as the single strip, impedance matching taper 160, the inside surface of the lower cone 120 may function as the outside conductor, or the return. That is, the conductive taper 160 used for impedance matching can be considered the center conductor of a coaxial feed mechanism where the inside of the lower cone 120 can serve as the outside conductor (or shielding conductor, or return) of the tapered feed 160.

The upper cone 110 can include an extension 140 where the extension may be cylindrical and may have a diameter substantially equal to widest opening of the upper cone 110. The lower cone 120 can include an extension 150 where the extension may be cylindrical and may have a diameter substantially equal to widest opening of the lower cone 120. Such extensions 140, 150 can support an increase in aperture length without increasing the aperture diameter. This increase in length can support lower frequency operation. In addition to being substantially cylindrical, the extensions 140, 150 may also have a smaller half-angle than the respective cone 110, 120 which it is extending. A cylinder can be considered the limiting case of reducing the half-angle of the radiator.

The addition of a cylindrical or reduced angle extension 140, 150 to a respective cone 110, 120 may be considered forming a cone with two segments of differing angles. Each cone 110, 120 may have 1, 2, 3, 4, 5, or more such segments. That is, each cone 110, 120 may have one or more extensions 140,150. The two cones 110,120 need not have the same number of segments or the same number of extensions 140, 150. The number of extensions 140, 150 to either or both cones 110,120 may also be zero.

Throughout the discussion of the figures, the conical antenna elements 110, 120 are referred to as the upper cone 110 and the lower cone 120 for consistency. One of ordinary skill in the art will appreciate, however, that the common axis of the conical structures may be vertical, horizontal, or at any desired angle without departing from the scope or spirit of the present invention. That is, the cones may be side-by-side or the upper cone 110 may be positioned below the lower cone 120.

Figure 2A:
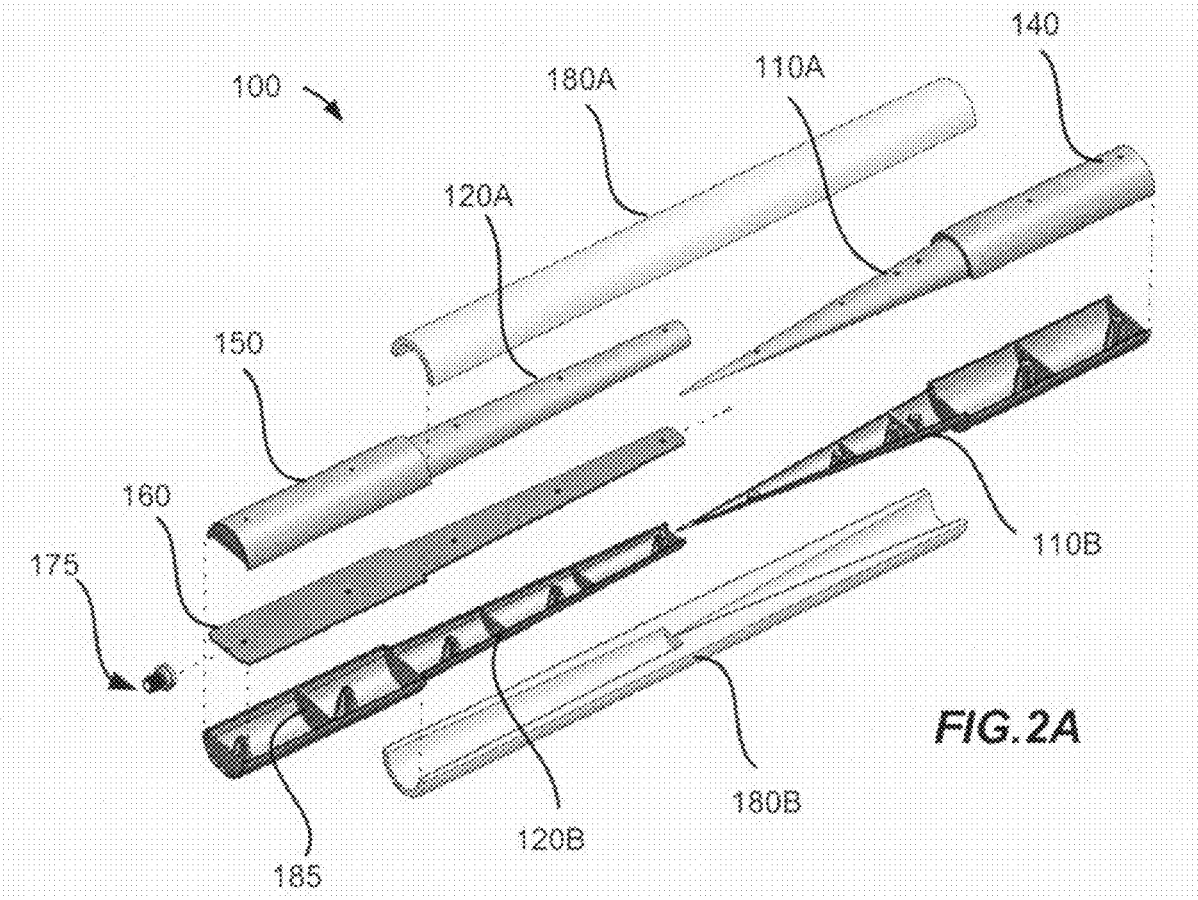
FIGS. 2A and 2B illustrate exploded views of a high impedance bicone antenna system according to one exemplary embodiment of the present invention.
Figure 2B:
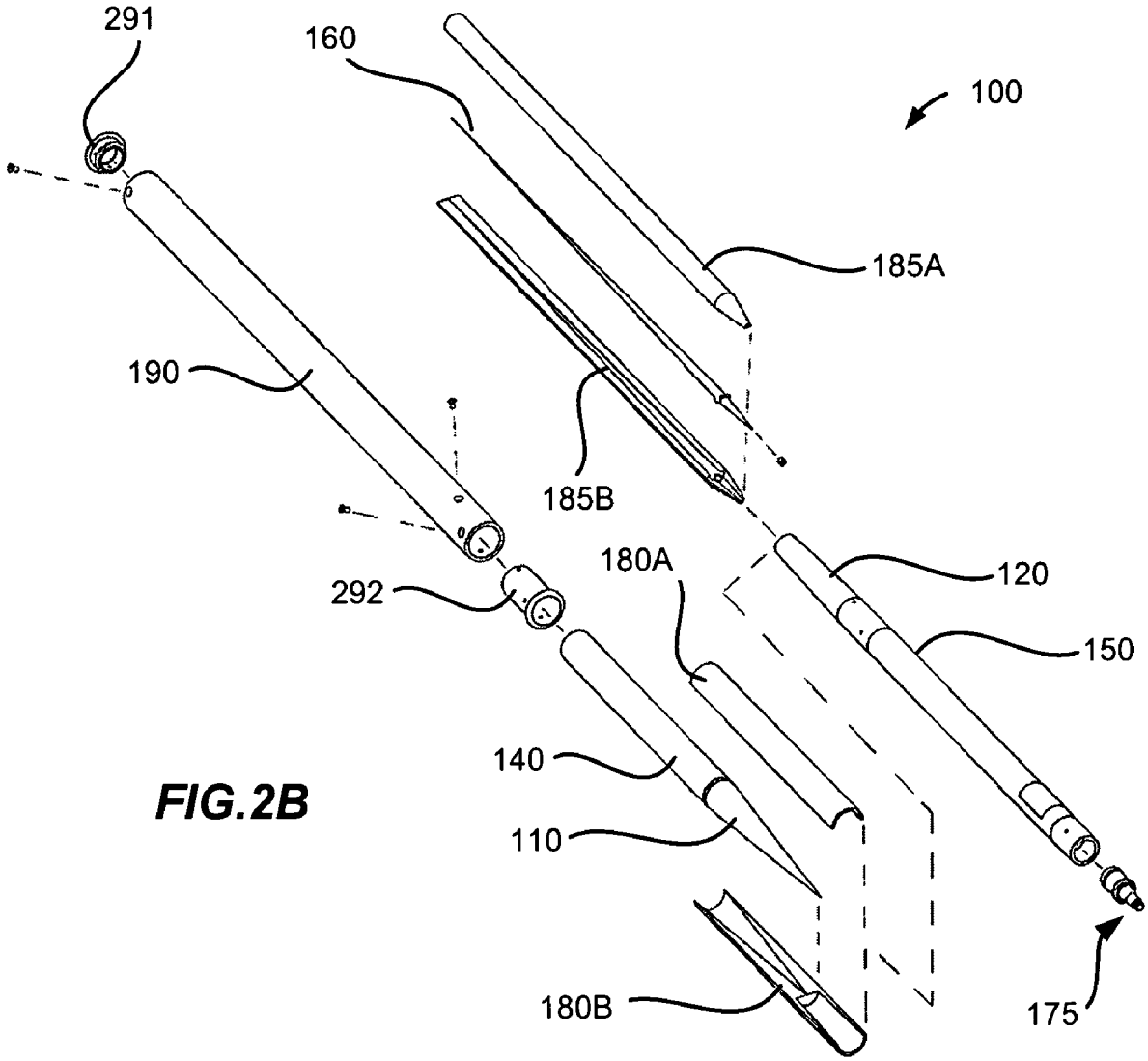

Turning now to FIGS. 2A and 2B, the figures illustrate exploded views of a high impedance bicone antenna system 100 according to one exemplary embodiment of the present invention. The upper cone 110 with its extension 140 may be formed as a first half 110A and a second half 110B. The upper cone 110 may also be formed as a single piece. The lower cone 120 with its extension 150 may be formed as a first half 120A and second half 120B. The lower cone 120 may also be formed as a single piece. Both the upper cone 110 and the lower cone 120 may be formed by molding, casting, stamping, milling, machining, rolling, cutting or any other technique for forming.

The impedance matching taper 160 can be connected at its tip to the tip of the upper cone 110. The impedance matching taper 160 can be supported within the lower cone 120 by a dielectric 185. The dielectric 185 illustrated in FIG. 2A can be a series of dielectric ribs. The dielectric 185 illustrated in FIG. 2B can be a foam with a low dielectric constant. The foam dielectric 185 can be provided as a single element or as a first half 185A and a second half 185B. The impedance matching taper 160 can be connected at its lower impedance end to a connector 175 for attaching a feed line to the antenna system 100.

A dielectric 180 can provide mechanical support around the cones 110, 120. Such mechanical support may operate to position and buffer the cones 110, 120 within a radome 190. The dielectric 180 can be formed of a first half 180A and second half 180B. The dielectric 180 can also be formed a single element. The dielectric 180 can be a foam that is thermally or chemically set in place around the cones 110, 120. The dielectric 180 can also be molded, machined, or otherwise formed.

As illustrated in FIG. 2B, the antenna system 100 may be assembled such that the impedance matching taper 160 and its supporting dielectric 185 are formed into the lower cone 120 and the lower cone extension 150. The connector 175 may be pressed or otherwise attached into the distal end of the lower cone extension 150 in order to electrically communicate with the impedance matching taper 160. The lower cone 120 and the upper cone 110 can come together such that the high impedance end of the impedance matching taper 160 engages with the vertex of the upper cone 110. The combined cones 110, 120; their extension tubes 140, 150; and the surrounding dielectric 180 may then be formed into the radome 190. A coupling collar 292 may be used to mechanically support an interface between the radome 190 and the lower cone extension 150 such that the radome 190 and the lower cone extension 150 become the predominate external elements of the fully assembled system. An end cap 291 may close off the top end of the radome 190. Aspects of the invention supporting these assembly steps may provide for a rugged and robust bicone system 100 that may be efficiently manufactured and assembled to reduce material handing and manufacturing costs.

Figure 3:
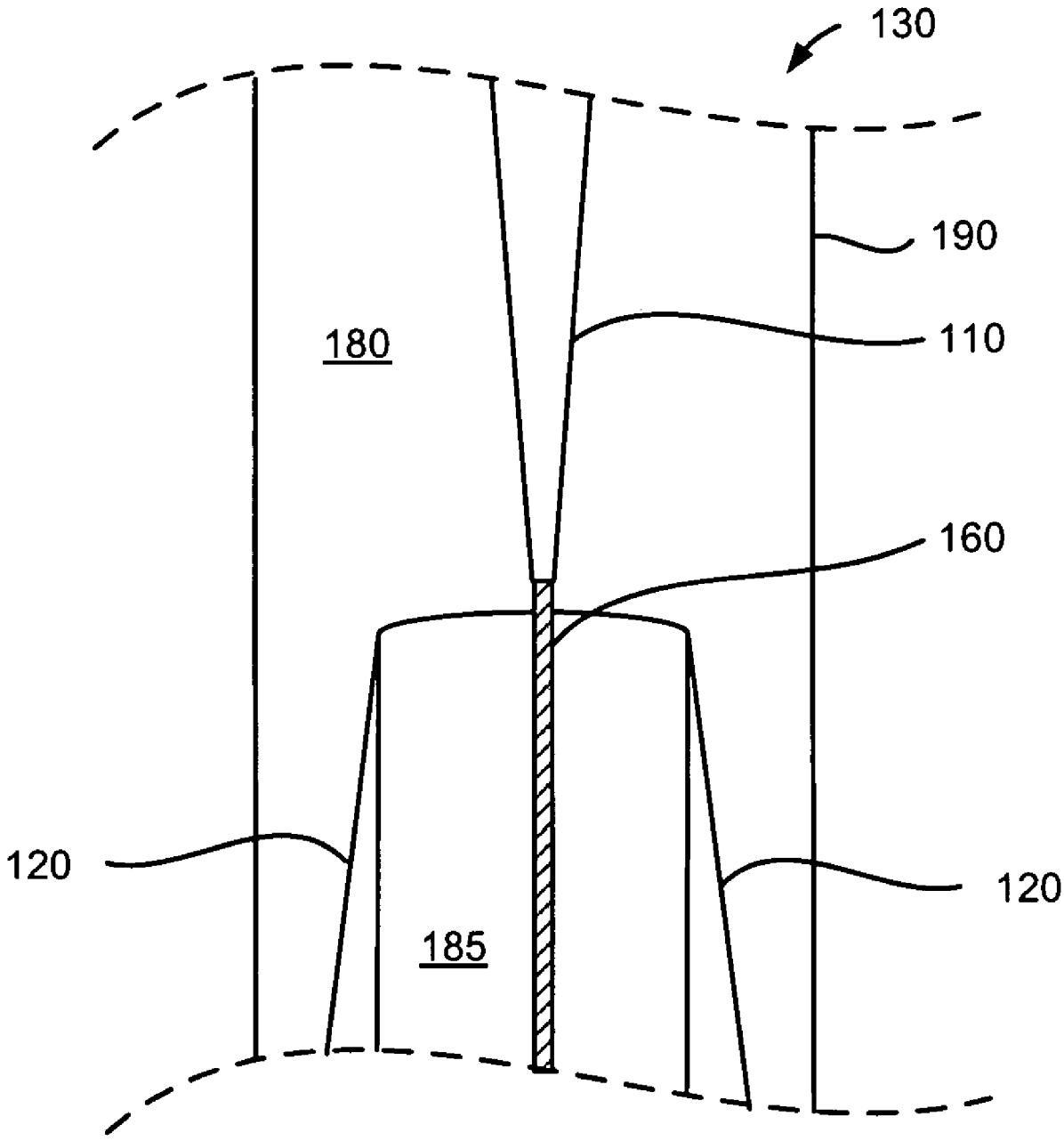
FIG. 3 illustrates a detail view of the feed point at the central vertex of a high impedance bicone antenna system according to one exemplary embodiment of the present invention.

Turning now to FIG. 3, this figure illustrates a detail view of the feed point at the central vertex 130 of a high impedance bicone antenna system 100 according to one exemplary embodiment. An opening provided at the vertex of the lower cone 120 may allow the impedance matching taper 160 that is positioned within the center of the lower cone 120 to pass through and electrically connect to the upper cone 110. The upper cone 110 and the lower cone 120 may be positioned within a radome 190 with a dielectric 180 filling, or partially filling the space between the cones 110, 120 and the radome 190. A dielectric 185 may fill or partially fill the area around the impedance matching taper 160 within the lower cone 120.

Although the impedance matching taper 160, as illustrated, is used to feed the antenna 100 through the lower cone 120, the impedance matching taper 160 may also feed the antenna 100 from the outside of the vertex point 130.

Figure 4:
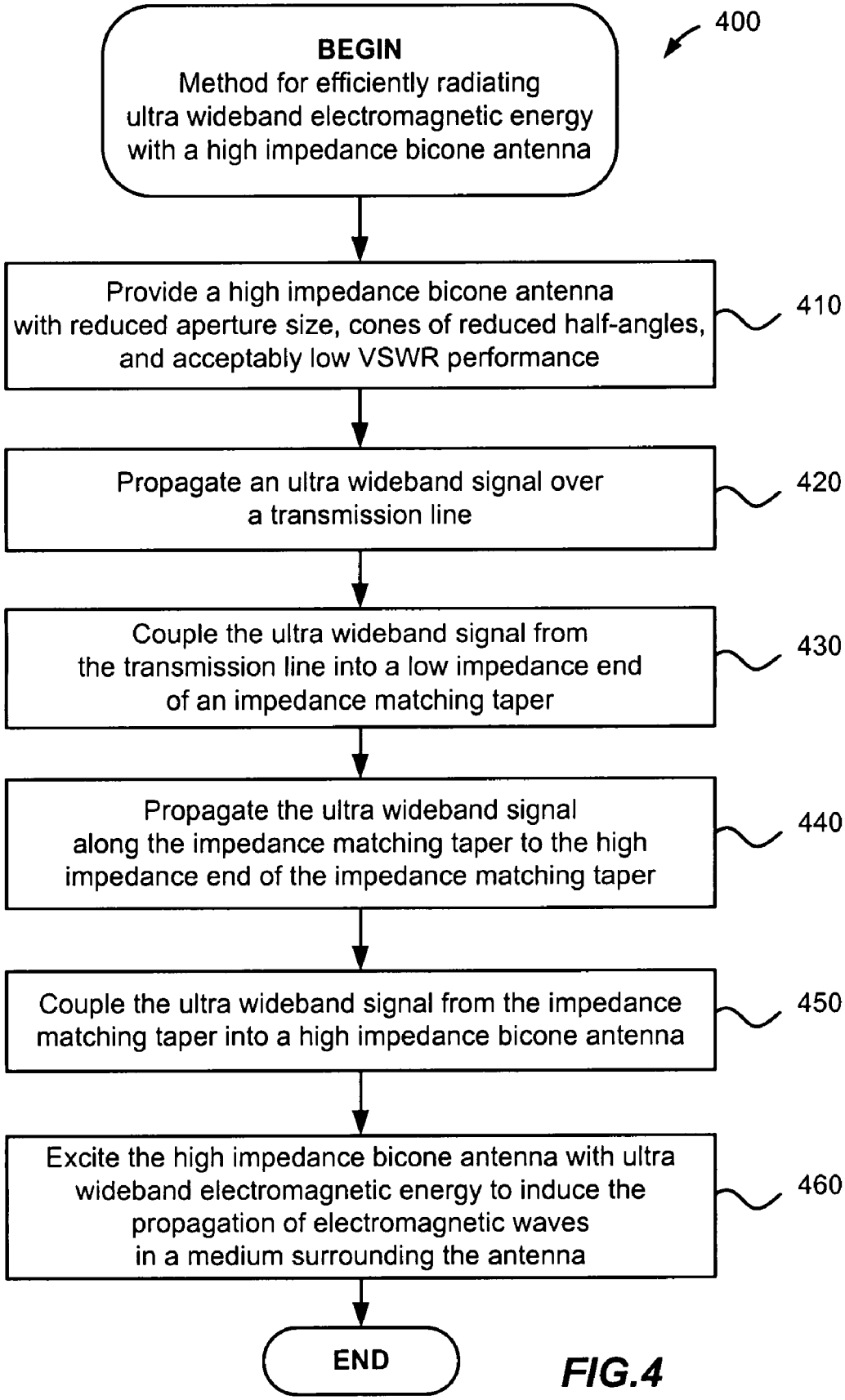
FIG. 4 is a logical flow diagram of a process for efficiently radiating ultra wideband electromagnetic energy with a high impedance bicone antenna according to one exemplary embodiment of the present invention.

Turning now to FIG. 4, the figure shows a logical flow diagram 400 of a process for efficiently radiating ultra wideband electromagnetic energy with a high impedance bicone antenna 100 according to one exemplary embodiment of the present invention. Certain steps in the processes or process flow described in the logic flow diagram referred to below must naturally precede others for the invention to function as described. However, the invention is not limited to the order of the steps described if such order or sequence does not alter the functionality of the invention. That is, it is recognized that some steps may be performed before, after, or in parallel with other steps without departing from the scope or spirit of the invention.

In Step 410, a high impedance bicone antenna 100 is provided for a communications application, i.e., transmission and/or reception of electromagnetic signals. The bicone antenna may have reduced aperture size, reduced half-angles, as well as acceptably low VSWR performance. The aperture size may less than about one fifth of a wavelength or smaller, for example, one tenth of a wavelength or smaller. The half-angles of the cones may be less than about thirty degrees, for example, and as small as three degrees or smaller. The VSWR performance may be less than 1:3 over an ultra wide bandwidth having a bandwidth ratio much greater than 1:20, for example.

In Step 420, an ultra wideband signal can be propagated over a transmission line.

In Step 430, the ultra wideband signal can be coupled from the transmission line into a low impedance end of an impedance matching taper 160. The signal coupling may employ a connector 175. The impedance matching taper 160 may also be any other mechanism for impedance matching, such as a transformer.

In Step 440, the ultra wideband signal can be propagated along the impedance matching taper to the high impedance end 130 of the impedance matching taper 160.

In Step 450, the ultra wideband signal can be coupled from the impedance matching taper 160 into a high impedance bicone antenna 100. In combination with Step 460, the high impedance bicone antenna 100 may be excited by the with ultra wideband electromagnetic energy to induce the propagation of electromagnetic waves from the antenna 100 in a medium surrounding the antenna 100. The exemplary process 400, while possibly operated continuously, may be considered complete after Step 460.

Although the process 400 is described above in connection with the radiation or transmission of an electromagnetic signal, the process 400 may also be operated in reverse due to electromagnetic reciprocity. Such reverse operation of process 400 may be considered signal reception where the antenna 100 operates as a receiving antenna that is excited by the surrounding medium instead of exciting the surrounding medium.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. An antenna system comprising:

a first conductive cone element;

a second conductive cone element positioned coaxially with the first conductive cone element to form a bicone antenna having a characteristic impedance greater than 90 ohms; and an impedance matching element operable to transform a characteristic impedance of an external feed line to the characteristic impedance of the bicone antenna, wherein the first conductive cone element has a first half angle of less than about thirty degrees, and the second conductive cone element has a second half angle of less than about thirty degrees, and wherein the first half angle is less than the second half angle, a vertex of the first conductive cone element is truncated to provide an opening in the first conductive cone element, the impedance matching element is positioned within the opening in the first conductive cone element, and the impedance matching element is in electrical communication with the second conductive cone element.

2. An antenna system comprising:

a first conductive cone element;

a second conductive cone element positioned coaxially with the first conductive cone element to form a bicone antenna having a characteristic impedance greater than 90 ohms; and an impedance matching element operable to transform a characteristic impedance of an external feed line to the characteristic impedance of the bicone antenna, wherein the impedance matching element comprises a tapered conductive strip.

3. The antenna system of claim 2, wherein the impedance matching element is positioned within the first conductive cone element, and an inside surface of the first conductive cone element is operable as a return signal conductor associated with a feed signal.

4. The antenna system of claim 2, further comprising a conductive cylindrical element positioned at an opening of the first conductive cone element and operable to extend a length of the first conductive cone element.

5. The antenna system of claim 2, wherein the impedance matching element is positioned within the first conductive cone element, the impedance matching element is in electrical communication with the second conductive cone element, and a vertex of the first conductive cone element is truncated to form an opening for the impedance matching element.

6. The antenna system of claim 2, further comprising a dielectric material positioned within the first conductive cone element and operable to maintain a position for the impedance matching element within the first conductive cone element.

7. An antenna system comprising:

a first conductive cone element;

a second conductive cone element positioned coaxially with the first conductive cone element to form a bicone antenna having a characteristic impedance greater than 90 ohms; and an impedance matching element operable to transform a characteristic impedance of an external feed line to the characteristic impedance of the bicone antenna, wherein an aperture size of the bicone antenna is less than one fifth of a lowest operating wavelength of the bicone antenna.

8. The antenna system of claim 7, wherein the first conductive cone element has a first half angle of less than five degrees, and the second conductive cone element has a second half angle of less than five degrees.

9. The antenna system of claim 7, further comprising a radome with a substantially cylindrical geometry.

10. The antenna system of claim 7, further comprising a dielectric material positioned within the first conductive cone element and within the second conductive cone element.

11. The antenna system of claim 7, further comprising a dielectric material positioned between and partially around the first conductive cone element and the second conductive cone element.

12. An antenna system comprising:

a first conductive cone element having a first half angle of less than thirty degrees; and a second conductive cone element having a second half angle of less than thirty degrees, and positioned coaxially with the first conductive cone element to form a bicone antenna, wherein an aperture size of the bicone antenna is less than one fifth of a lowest operating wavelength of the bicone antenna.

13. The antenna system of claim 12, wherein the bicone antenna has a characteristic impedance greater than 90 ohms.

14. The antenna system of claim 12, further comprising an impedance matching element operable to match a characteristic impedance of an external feed line to a characteristic impedance of the bicone antenna.

15. A method for efficiently radiating ultra wideband electromagnetic energy with a high impedance bicone antenna comprising the steps of:

providing a high impedance bicone antenna comprising an aperture size less than one fifth of a lowest operating wavelength, a first half-angle less than thirty degrees within a first conductive cone element, a second half-angle less than thirty degrees within a second conductive cone element, and ultra wideband performance having a frequency bandwidth ratio greater than one-to-twenty;

matching an impedance of an ultra wideband signal to the high impedance bicone antenna using an impedance matching element; and exciting the high impedance bicone antenna with the ultra wideband signal to induce propagation of electromagnetic waves in a medium surrounding the antenna.

16. The method of claim 15, wherein the step of providing a high impedance bicone antenna comprises assembling elements of the antenna system by slipping the elements together within an external cylindrical radome through an open end of the external cylindrical radome.

17. The method of claim 15, wherein the step of matching an impedance of the ultra wideband signal to the high impedance bicone antenna comprises inserting a tapered conductive impedance matching element into the bicone antenna.

18. An antenna system comprising:

a first conductive cone element comprising a first half angle of less than approximately thirty degrees;

a second conductive cone element comprising a second half angle of less than approximately thirty degrees, and disposed coaxially with the first conductive cone element to form a bicone antenna; and an impedance matching element operable to transform a characteristic impedance of an external feed line to a characteristic impedance of the bicone antenna, wherein the impedance matching element comprises a tapered conductive strip.

* * * * *